United States Patent [19]

Goodlaxson

[11] 4,072,867

[45] Feb. 7, 1978

[54] MOTOR ENERGIZED LATCH MECHANISM

[75] Inventor: John D. Goodlaxson, Colfax, Iowa

[73] Assignee: The Maytag Company, Newton, Iowa

[21] Appl. No.: 679,737

[22] Filed: Apr. 23, 1976

[51] Int. Cl.[2] ..... H01H 27/06

[52] U.S. Cl. ..... 307/118; 318/227

[58] Field of Search ..... 200/61.64; 310/4 A; 318/227, 225; 307/116, 117, 118, 112

[56] References Cited

U.S. PATENT DOCUMENTS

| | | | |
|---|---|---|---|
| 3,471,939 | 10/1969 | Janke | 318/227 |
| 3,617,957 | 11/1971 | Brighenti | 200/61.64 |

*Primary Examiner*—Herman J. Hohauser
*Attorney, Agent, or Firm*—Richard L. Ward

[57] ABSTRACT

A latch mechanism for an apparatus having a rotatable member, a cabinet enclosing the rotatable member and an access door on the cabinet. The latch mechanism includes a first portion on the access door and a second portion on the cabinet which cooperate to lock the access door in the closed position at predetermined times in a cycle of operations. The second portion of the latch mechanism is controlled through a bimetal actuator which is heated by a low voltage current inductively generated in an auxiliary winding associated with a pump motor.

7 Claims, 5 Drawing Figures

MOTOR ENERGIZED LATCH MECHANISM

BACKGROUND OF THE INVENTION

1. Field of the Invention

This invention relates generally to latch mechanisms and more particularly to a latch mechanism in which locking is initiated by a bimetal actuator energized by an electrical current inductively generated in an auxiliary winding on an electric motor.

2. Description of the Prior Art

The prior art shows a continuing search for a latching system such as for locking the access door of a laundry washing apparatus during periods of high speed rotation. United States Patent No. 3,458,675 for example utilizes a resistance wire wound bimetal for moving a bolt to lock the access door. Also, U.S. Pat. No. 2,738,072 in one embodiment, uses a resistance wire wound bimetal to move a latch into engagement with an access door. Further, in U.S. Pat. No. 2,974,832 which relates to actuating a detergent dispenser, a separate transformer connected through a timer energizes a nichrome wire to actuate the dispenser at a predetermined time in the cycle of operations.

SUMMARY OF THE INVENTION

It is an object of the instant invention to provide a bimetal mechanism for actuating a locking member.

It is a further object of the instant invention to provide an improved latch mechanism for locking the access door of a centrifugal apparatus.

It is a further object of the instant invention to provide for locking of the access door during predetermined portions of a cycle of operations using a function of the operation to effect the locking.

It is a further object of the instant invention to provide a low voltage current for energizing a bimetal operated latch mechanism without a separate transformer.

The instant invention achieves these objects in a bimetal actuator controlled latch mechanism for an apparatus that includes a drive means including at least one electric motor operable during predetermined parts of a cycle of operations. The motor includes an auxiliary winding in which a low voltage electrical current is inductively generated when the motor is energized for operation. The auxiliary winding is electrically connected for heating a bimetal strip which in turn is associated with a locking member. When electrical current passes through the bimetal and deforms it, the locking member is moved into locking engagement. In a specific embodiment, the drive means includes a first motor for actuating a rotatable portion of a centrifugal apparatus and a second motor for driving a drain pump. The auxiliary winding is associated with the second motor and actuates the bimetal strip whenever the drain pump is actuated. The drain pump is actuated during periods of high speed spin and thus the access door is locked during these periods for preventing access to the rotatable member.

Operation of the system and further objects and advantages thereof will become evident as the description proceeds and from an examination of the accompanying two pages of drawings.

BRIEF DESCRIPTION OF THE DRAWINGS

The drawings illustrate a preferred embodiment of the invention with similar numerals referring to similar parts throughout the several views wherein.

DESCRIPTION OF A PREFERRED EMBODIMENT

Figure 1:
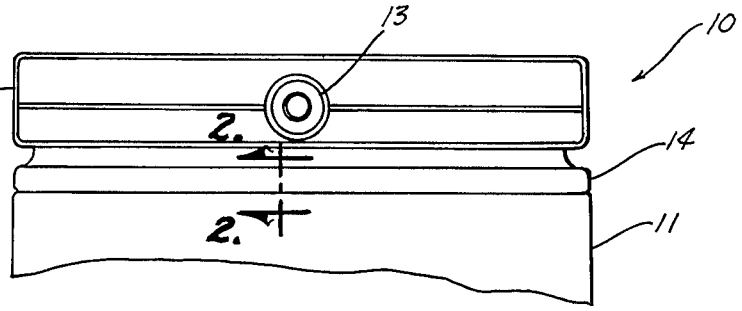
FIG. 1 is a partial front view of an automatic washing machine showing the cabinet top, control panel and dial.
Figure 2:
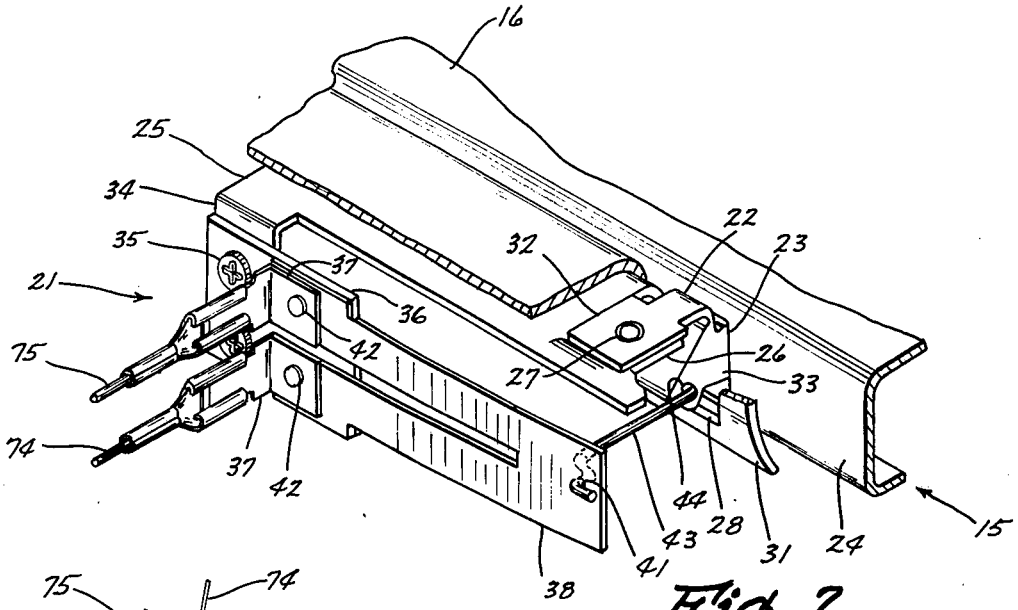
FIG. 2 is a fragmentary perspective view taken generally along lines 2—2 of FIG. 1.

Referring now to the drawings, there is shown in FIG. 1 a partial view of an automatic washing machine 10 including a cabinet 11. The cabinet 11 includes a control panel 12 accommodating various control members such as sequential control means or timer actuatable by a dial 13. As shown in FIGS. 1 and 2, the cabinet 11 also includes a top cover 14 which includes an access opening 15 through which fabrics may be inserted or removed from a rotatable fabric basket. The access opening 15 is closed by a hinged panel comprising an access door 16 movable to an open position.

Figure 3:
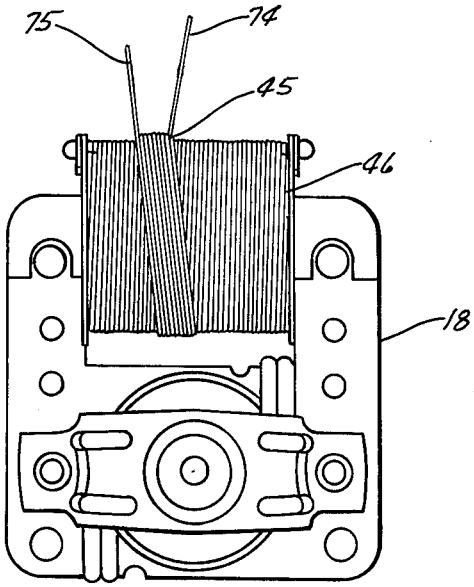
FIG. 3 is a view of a pump drive motor with an auxiliary winding shown around the primary winding.
Figure 4:
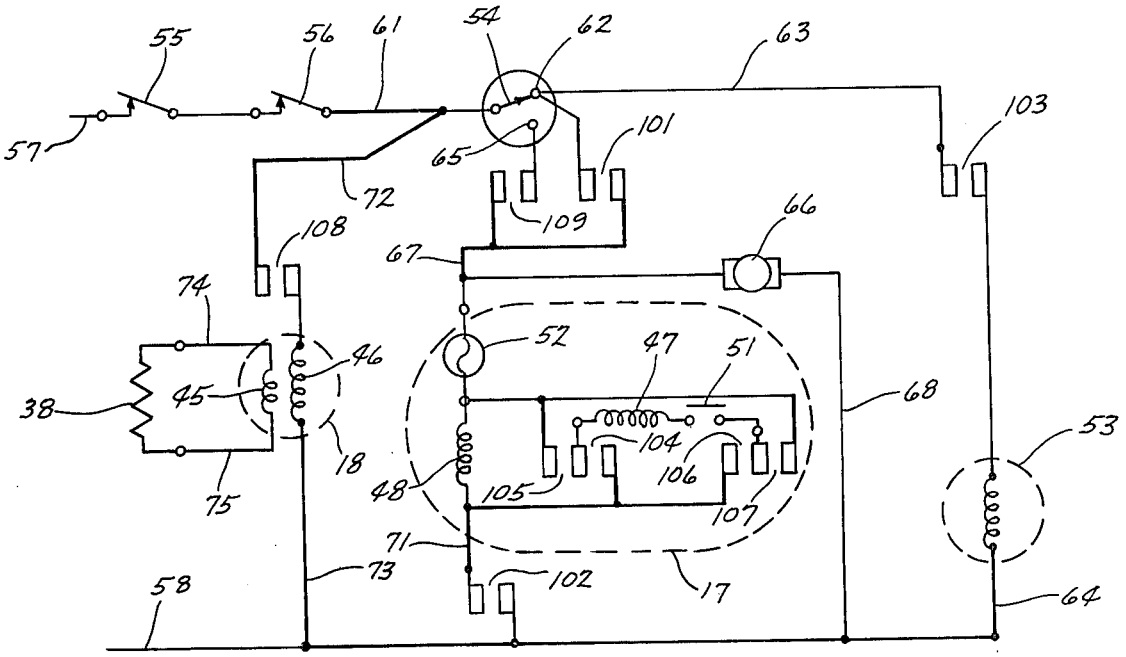
FIG. 4 is a schematic electrical circuit showing operational and control components of the washing machine of FIG. 1.

Supported within the cabinet structure 11 but not physically shown in the drawings is a base frame, a reversible drive motor 17, shown schematically in the electrical circuit of FIG. 4, a transmission, a tub assembly including a rotatable fabric basket and a pump system. The pump motor 18 is shown in FIG. 3 and schematically in FIG. 4.

A typical automatic washing machine structure is shown in U.S. Pat. No. 3,197,271 issued July 27, 1965 and assigned to the assignee of the present invention. U.S. Pat. No. 3,197,271 utilizes a single reversible drive motor for pumping, agitation and high speed rotation for extraction. The present construction differs from the U.S. Pat. No. 3,197,271 structure in that two drive motors are used, a first for agitation and high speed rotation and a second for pumping.

As will be more fully shown hereinbelow the sequential control means programs the machine through a sequence of operations including energization of the drive motor 17 for rotation in a first direction to effect a washing and/or rinsing function followed, at a later point in a regular cycle of operations, by energization of the drive motor 17 for rotation in a second direction to effect a spin function. When the drive motor 17 is energized to effect the spin function the pump motor 18 is also energized to effect a pumping of the washing fluid from the tub.

There is shown in FIG. 2, for the purpose of locking the access door 16 during predetermined portions of a cycle of operations, a bimetal assembly 21 which is operable for actuating a locking member 22 into engagement with the access door 16. The preferred embodiment, shown in an engaged position in FIG. 2, includes a rectangular indentation 23 in the access door side wall 24. This rectangular indentation 23 is shaped to receive the locking member 22 which is pivotally mounted on a channel shaped mounting bracket 25 under the top cover 14.

The mounting bracket 25 is formed of sheet metal and is fastened to the underside of the top cover 14 adjacent the access door by two threaded fasteners (not shown). At one end of the mounting bracket 25, a tab 26 is formed for mounting the locking member 22. The locking member 22 is secured to the tab 26 by a rivet 27. Adjacent the tab 26, a clearance slot 28 is cut out of the channel wall 31. This slot 28 allows a portion of the locking member 22 to engage with the indentation 23 in the access door 16. The unitary locking member 22 is molded of a flexible thermoplastic material and is centrally hinged forming two portions, a first portion 32 for fastening to the mounting bracket 25 and a second portion 33 for cooperating with the rectangular indentation 23 of the access door 16 to lock the door 16 in a closed position.

At the opposite end of the mounting bracket 25 a leg 34 is bent down to mount a bimetal assembly 21 using two threaded fasteners 35 as shown in FIG. 2. The bimetal assembly 21 is comprised of an electrical insulating block 30, two male electrical terminals 37 and a bifurcated rectangular bimetallic strip 38 having a hole 41 in the non-bifurcated end. The terminals 37 and the bimetallic strip 38 are riveted to the insulating block with rivets 42 to form the bimetal assembly 21 shown in FIG. 2.

As further shown in FIG. 2, the bimetal strip 38 and the locking member 22 are operatively connected by an actuating link or rod 43 which extends between the hold 41 in the bimetal strip 38 and a hole 44 in the locking member 22. When the bimetal strip 38 is heated, it deforms as shown in FIG. 2 to move the actuating link 43 and in turn the locking member 22 into engagement with the indentation 23 in the access door 16.

In order to actuate the bimetal assembly 21 to lock the access door 16, the bimetal assembly 21 is electrically connected to an auxiliary winding 45 on the drain pump motor 18 as shown in FIG. 3. In a specific example, the auxiliary winding 45 consists of 6 or 7 turns of 0.039 diameter wire to produce 0.8 to 1 volt at 8 to 12 amperes. This auxiliary winding 45 is wrapped around the motor winding 46 and generates this low voltage electrical current by induction. The auxiliary winding 45 extends directly from the pump motor 18 to the bimetal terminals 37 and each time the pump motor 18 is actuated a current is generated and the bimetal strip 38 is deformed to lock the access door 16.

Figure 5:
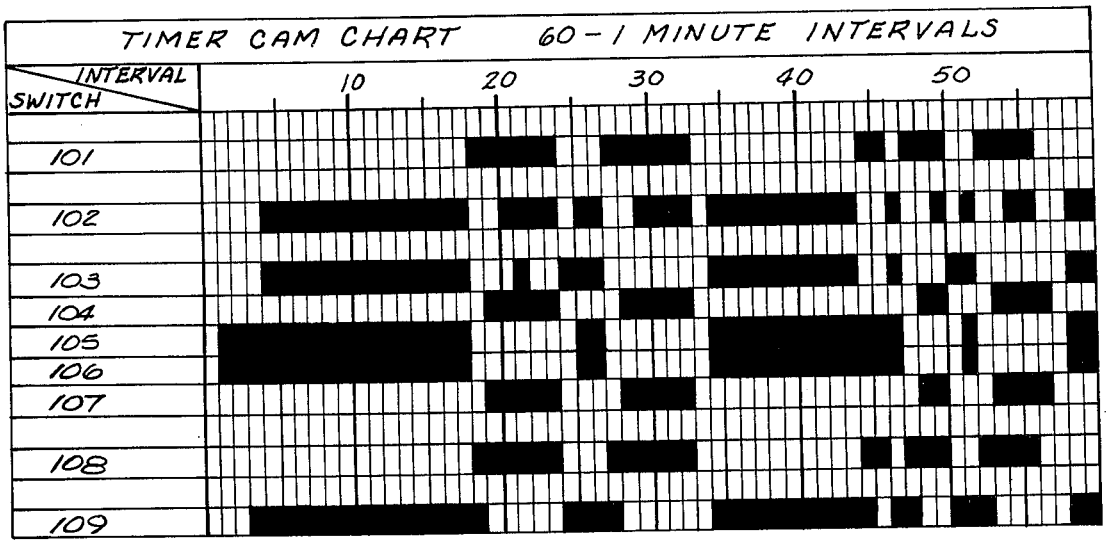
FIG. 5 is a timer cam chart showing the sequential switching of cam-operated switches of the electrical circuit of FIG. 4.

There is shown in FIGS. 4 and 5, an electrical schematic circuit and related chart showing a specific operation of switch members of the circuit. The circuit of FIG. 4 includes a plurality of contact pairs operable between open and closed positions by a set of cams under the control of a timing motor. The contact pairs function as switching means and are referred to as timer switches whose opening and closing is shown by the cam chart of FIG. 5.

The circuit of FIG. 4 also includes the drive motor 17 comprising a start winding 47, a run winding 48, centrifugal switch 51, and fuse 52. Timer switches 104–107 as shown in FIG. 4 control functions of the drive motor 17 but are not physically associated with the drive motor 17. Also shown diagrammatically in FIG. 4 is the water valve 53, pump motor 18 with auxiliary winding 45, run winding 46, and bimetal strip 38. The circuit still further includes a pressure switch 54, a lid operated switch 55 and a line switch 56 to initiate operation such as may be operated to the closed position by the operator axially moving the timer dial 13. The circuit may be connected to a conventional 110 volt, 60 Hz power supply by the line conductors 57 and 58.

As previously indicated a specific embodiment of the instant invention is directed to the object of providing a lock for the access door 16 of a centrifugal apparatus. It is desirable that this lock be actuated during predetermined periods of spinning and remain actuated for a brief period following the spinning.

The normal washing cycle of operations of an automatic washing machine 10 includes, in sequence, an initial liquid filling of the machine 10, agitation to effect washing of the fabrics; removal of the washing fluid; a refilling of the apparatus with rinse water; agitation to effect rinsing of the fabrics; and removal of the rinse water from the machine 10.

To more fully explain the operation of the circuit a specific cycle selection will be assumed. Referring to FIG. 5, a "Regular" cycle extends from interval 4 to interval 33, a "Permanent Press" cycle runs from interval 34 to interval 57, and a "Soak" cycle runs from interval 58 to interval 60. These cycles are selected by the operator rotating the timer dial 13 to the start position of the desired cycle. It is thus assumed that a "Regular" cycle of operations is selected.

As previously indicated the "Regular" cycle of operations is selected by rotating the timer dial 13 to the start position which in this case would be interval 4 of the timer chart. With the selection of the "Regular" cycle of operations, and the timer mechanism positioned at increment 4, timer switches 102, 103, 105, 106, and 109 will be closed. Upon the operator closing the line switch 56, as by axially moving the timer dial 13 and assuming that the lid switch 55 has been closed by closing the lid or access door 16, the machine will be energized for initiating the "Regular" cycle of operations.

In interval 4 a circuit is completed through line conductor 57, the lid switch 55, the line switch 56, conductor 61, the pressure switch 54 made to the "empty" contact 62, through conductor 63, and closed timer switch 103 to the water valve 53. The other side of the water valve is connected to line conductor 58 through conductor 64. The water valve will operate until the pressure switch 54 operates from the "empty" contact 62 to the "full" contact 65. When the pressure switch 54 moves to the "full" contact 65 a circuit is completed to the timer motor 66 through timer switch 109, and conductor 67 for energizing the timer motor 66. The other side of the timer motor 66 is connected to line 58 by conductor 68.

The drive motor 17 will be energized to initiate agitation of the fluid and the fabrics within the tub. The drive motor 17 circuit extends from line conductor 57, through the lid switch 55, the line switch 56, the pressure switch 54 made to "full" contact 65, the timer switch 109 and through conductor 67 to one side of the drive motor 17. The other side of the motor 17 is connected through conductor 71 and the timer motor interrupter switch 102 to line conductor 58. Beginning at the fourth interval the apparatus will proceed through the "Regular" cycle of operations comprising washing and rinsing functions under control of the sequence of control mechanism.

Referring to FIGS. 4 and 5, when the motor interrupter switch 102 opens after interval 18, the drain pump 18 will be energized in interval 20 to initiate a pump-out of the washing fluid. One side of the drain pump 18 circuit is made from conductor 61 through conductor 72 and timer switch 108. The other side is made to line conductor 58 by conductor 73. The drain pump 18 will continue operation through interval 24 when the first spin operation ceases.

When the drain pump 18 is energized, a low voltage current is inductively generated in the auxiliary winding 45 which is connected in series with the bimetal strip 38 through conductors 74 and 75. The bimetal strip 38 will fully deform in approximately 10 seconds when the current passes through it actuating the locking member 22 through the actuating link 43 as shown in FIG. 2. It is apparent from FIGS. 4 and 5 that the bimetal strip 38 is actuated whenever the drain pump 18 is energized. The drain pump 18 is energized during all periods of spin, therefore the access door 16 is always locked during these periods of spin. Since the bimetal strip 38 deforms from the heat generated by passing the current through it, the bimetal strip 38 will remain deformed for the short interval of time necessary to achieve an equilibrium temperature when the spinning has ceased which will assure that the tub rotation will be stopped prior to opening the access door 16. This characteristic of returning to an equilibrium temperature and original form allows a fail safe operation. If the power should fail, the access door 16 will remain locked for a short period of time while the bimetal strip 38 cools. After this cooling period the door 16 can be opened for access to the rotatable fabric basket.

Several previous bimetallic actuators for dispensers and latches have been actuated by the full load motor current of a drive motor such as 17 connected in series with a bimetal strip 38. The full load motor current of the pump motor 18, 1½ amperes in this case, is not sufficient to heat the bimetal strip 38. The auxiliary winding 45 on the drain pump 18 produces a safe low voltage current which is isolated from the power lines 57 and 58. The primary advantage of using the motor winding 46 as a part of the transformer is one of cost over a complete transformer.

The bimetal assembly 21 is not limited to being used for actuating an access door lock. The assembly 21 may be used for dispensers, valves or anything that requires mechanical movement in either a remote or an accessible location.

This application thus describes an improved system which provides a latch mechanism for locking the access door 16 of a centrifugal apparatus. The system effects operation of a bimetal strip 38 using a current generated by an auxiliary winding 45 in the drain pump motor 18. Effectively the drain pump windings 45 and 46 function as a transformer without the added cost of a transformer.

In the drawings and specification there is set forth a preferred embodiment of the invention and through specific terms are employed these are used in a generic and descriptive sense only and not for purpose of limitation. Changes in form and the proportion of parts as well as the substitution of equivalents are contemplated as circumstances may suggest or render expedient without departing from the spirit or scope of this invention as defined in the following claims.

I claim:

1. A bimetal actuated latch mechanism for an apparatus including an electric motor operable under control of first circuit means during predetermined portions of a cycle of operations, the combination comprising: a bimetal element having a displaceable portion; means for heating said bimetal element to effect movement of said displaceable portion and including a pair of electric terminals; an auxiliary winding on said electric motor for inductively generating a low voltage current when said electric motor is energized; second circuit means for connecting said auxiliary winding to said pair of terminals, said second circuit means being independent of said first circuit means and responsive to said motor operation to effect heating of said bimetal element and to induce movement of said displaceable portion; and latch means responsive to the movement of said displaceable portion.

2. A latch mechanism as defined in claim 1 wherein said latch means is movable to a locking position.

3. An access door latch mechanism for a centrifugal apparatus operable under control of first circuit means through a cycle of operations, the combination comprising: drive means including an electric motor energizable through said first circuit means during predetermined portions of said cycle of operations; cabinet means including an access door operable between a closed position and an open positon; movable latch means for locking said access door in said closed position during predetermined portions of said cycle of operations; a bimetal element having a displaceable portion; means for heating said bimetal element to effect movement of said displaceable portion and including a pair of electrical terminals; an auxiliary winding on said electric motor for inductively generating a low voltage current when said electric motor is energized; second circuit means for connecting said auxiliary winding to said pair of terminals, said second circuit means comprising a low voltage closed loop path independent of said first circuit means and responsive to said motor energization to effect heating of said bimetal element and to induce movement of said displaceable portion; and actuating means responsive to said displaceable portion of said bimetal element for operating said latch means.

4. A latch mechanism as defined in claim 3 wherein said actuating means includes an actuating link operatively connecting said movable latch means and said displaceable portion of said bimental element.

5. An access door latch mechanism for a centrifugal apparatus having a rotatable member and operable under control of first circuit means through a cycle of operations, the combination comprising: a first electric motor for actuating said rotatable member during portions of said cycle of operations; a second electric motor energizable through said first circuit means during predetermined portions of said cycle of operations for operating a drain pump; cabinet means including an access door operable between a closed position and an open position; movable latch means for locking said access door in said closed position; a current heated bimetal element having a displaceable portion; means for heating said bimetal element to effect movement of said displaceable portion and including a pair of electrical terminals; an auxiliary winding on said second electric motor for inductively generating a low voltage current when said second motor is energized; second circuit means for connecting said auxiliary winding to said pair of terminals, said second circuit means comprising a low voltage closed loop path independent of said first circuit means and responsive to said motor energization to effect heating of said bimetal element by said low voltage current when said second motor is energized for inducing movement of said displaceable portion; and an actuating means responsive to said displaceable portion of said bimetal element for operating said latch means.

6. A latch mechanism as defined in claim 5 wherein said second motor is energized to actuate said bimetal element and lock said access door whenever said first motor is energized for high speed rotation of said rotatable member.

7. A latch mechanism as defined in claim 6 wherein said bimetal element remains displaced for a predetermined interval following said period of high speed rotation to prevent access to said rotatable member.

* * * * *